US011760081B2

(12) United States Patent
Miyamoto et al.

(10) Patent No.: US 11,760,081 B2
(45) Date of Patent: Sep. 19, 2023

(54) LITHOGRAPHIC PRINTING PLATE PRECURSOR AND METHOD OF USE

(71) Applicant: Eastman Kodak Company, Rochester, NY (US)

(72) Inventors: Yasushi Miyamoto, Tatebayashi (JP); Masamichi Kamiya, Oura-gun (JP); Maru Aburano, Tatebayashi (JP); Jeremy Marc Yatvin, Atlanta, GA (US)

(73) Assignee: EASTMAN KODAK COMPANY, Rochester, NY (US)

( * ) Notice: Subject to any disclaimer, the term of this patent is extended or adjusted under 35 U.S.C. 154(b) by 112 days.

(21) Appl. No.: 17/387,044

(22) Filed: Jul. 28, 2021

(65) Prior Publication Data

US 2022/0072844 A1 Mar. 10, 2022

Related U.S. Application Data

(60) Provisional application No. 63/074,570, filed on Sep. 4, 2020.

(51) Int. Cl.
*B41C 1/10* (2006.01)

(52) U.S. Cl.
CPC ..... *B41C 1/1016* (2013.01); *B41C 2210/04* (2013.01); *B41C 2210/08* (2013.01); *B41C 2210/22* (2013.01); *B41C 2210/24* (2013.01); *B41C 2210/26* (2013.01)

(58) Field of Classification Search
CPC ..... B41C 1/10
See application file for complete search history.

(56) References Cited

U.S. PATENT DOCUMENTS

| | | | | |
|---|---|---|---|---|
| 2003/0008228 | A1 | 1/2003 | Aoshima et al. | |
| 2003/0157433 | A1 | 8/2003 | Timpe et al. | |
| 2003/0203313 | A1 | 10/2003 | Goto | |
| 2003/0207203 | A1 | 11/2003 | Tsuchimura et al. | |
| 2008/0311520 | A1* | 12/2008 | Yu | B41C 1/1016 430/286.1 |
| 2011/0104450 | A1 | 5/2011 | Memetea et al. | |
| 2019/0022993 | A1 | 1/2019 | Igarashi et al. | |

FOREIGN PATENT DOCUMENTS

| | | | |
|---|---|---|---|
| JP | 2002090985 | A | 3/2002 |
| JP | 2002331768 | A | 11/2002 |
| JP | 2005014230 | A | 1/2005 |
| JP | 2009172855 | A * | 8/2009 |
| JP | 2017149028 | A | 8/2017 |
| JP | 20200179567 | A | 11/2020 |
| WO | 2019/243036 | A1 | 12/2019 |

OTHER PUBLICATIONS

Machine Translation JP2009172855 A ( Original/Machine) (Year: 2022).*

* cited by examiner

*Primary Examiner* — Chanceity N Robinson
(74) *Attorney, Agent, or Firm* — J. Lanny Tucker

(57) ABSTRACT

A lithographic printing plate precursor has an infrared radiation-sensitive image-recording layer containing an IR absorber, and an ozone-blocking material of 1500 or less molecular weight and has structure (I), (II), or (III):

$$(R)_m\text{—}A\text{—}(OH)_n \quad \text{(I)}$$

wherein R is a hydrocarbon having 14-30 carbon atoms; m is 1 or 2; n is 1-6; the sum of m and n is >2 and <8; and A is a multivalent organic moiety free of R and OH groups and has a valence m+n;

(II)

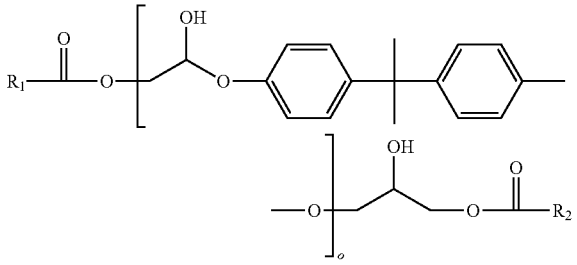

wherein $R_1$ and $R_2$ are alkyl groups of 14-22 carbon atoms, and o is 1-3;

$$R_3C(=O)NR_4R_5 \quad \text{(III)}$$

wherein $R_3$ is an alkenyl with a C=C bond within a carbon-carbon chain of 16-30 carbons, and $R_4$ and $R_5$ are hydrogen or unsubstituted alkyls of 1-4 carbon atoms. Such ozone-blocking materials can be used to protect infrared radiation-sensitive dyes that may be degraded by ozone and thus improve imaging sensitivity.

13 Claims, No Drawings

LITHOGRAPHIC PRINTING PLATE PRECURSOR AND METHOD OF USE

FIELD OF THE INVENTION

This invention relates to infrared radiation-sensitive lithographic printing plate precursors that can be imaged using infrared radiation to provide imaged lithographic printing plates. Such precursors include a low molecular weight ozone-blocking material that can protect IR dyes that are sensitive to ambient ozone and thereby improve precursor imaging sensitivity. The inventive precursors are particularly negative-working and on-press developable. This invention also relates to methods of using these precursors to provide lithographic printing plates after appropriate imaging and development.

BACKGROUND OF THE INVENTION

Imaging systems, such as computer-to-plate (CTP) imaging systems are known in the art and are used to record an image on a lithographic printing plate precursor. Such precursors comprise a substrate typically composed of aluminum that has a hydrophilic surface on which one or more radiation-sensitive imageable layers are disposed. In lithographic printing, lithographic ink receptive regions, known as image areas, are generated on the hydrophilic surface of the substrate. When the printing plate surface is moistened with water and a lithographic printing ink is applied, hydrophilic regions retain the water and repel the lithographic printing ink, and the lithographic ink receptive image regions accept the lithographic printing ink and repel the water. The lithographic printing ink is transferred to the surface of a material upon which the image is to be reproduced, perhaps with the use of a blanket roller.

Lithographic printing plate precursors are considered either "positive-working" or "negative-working." Positive-working lithographic printing plates precursors are designed with one or more radiation-sensitive layers such that upon imagewise exposure to suitable radiation such as infrared radiation, the exposed regions of the layers become more alkaline solution soluble and can be removed during processing to leave the non-exposed regions that accept lithographic ink for printing.

In contrast, negative-working lithographic printing plate precursors are designed with a radiation-sensitive layer such that upon imagewise exposure to suitable radiation such as infrared radiation, the exposed regions of the layer are hardened and become resistant to removal during processing, while the non-exposed regions are removable during processing.

In the current state of the art in the lithographic printing industry, lithographic printing plate precursors are usually imagewise exposed to imaging radiation such as infrared radiation using lasers in an imaging device commonly known as a platesetter (for CTP imaging) before additional processing (development) to remove unwanted materials from the imaged precursors.

In recent years, there has been an increased desire in the lithographic printing industry for simplification in making lithographic printing plates by carrying out development on-press ("DOP") using a lithographic printing ink or fountain solution, or both, to remove non-exposed regions of the image-recording layer. Thus, use of on-press developable lithographic printing plate precursors is being adopted more and more in the printing industry due to many benefits, including less environmental impact and savings on processing chemicals, processor floor space, and operation and maintenance costs. After laser imaging, on-press developable precursors can be taken directly to lithographic printing presses.

Many of these positive-working and negative-working lithographic printing precursors used in the industry are designed to be sensitive to near-infrared or infrared radiation (typically radiation having a radiation of at least 800 nm). Such sensitivity can be provided with various infrared radiation sensitive dyes, many of which are known in the art. It has become particularly desirable to design negative-working precursors such as those that are developable on-press containing such infrared radiation-sensitive dyes. Useful infrared radiation-sensitive dyes can be cyanine dye compounds comprising polymethine chains between chromophore moieties.

However, it has been found that many of such infrared radiation-sensitive dyes are particularly vulnerable to attack or reduction in imaging sensitivity in the presence of ambient ozone, especially when such compounds are incorporated into uppermost layer(s) of the precursors. It has been also observed that such precursors can lose their on-press durability when this ozone exposure problem is pronounced. These problems can be particularly acute when the precursors are stored for lengthy time before they are exposed, processed (developed), and used for lithographic printing.

U.S. Patent Application Publication 2019/0022993 (Igarashi et al.) describes the use of specifically placed filters in combination with specially designed imaging apparatus (such as a platesetter) to remove ambient ozone to reduce the impact of ozone on negative-working lithographic printing plate precursors.

Having discovered the problems caused by ambient ozone, there is a need to solve it for the lithographic printing industry so that imaging sensitivity is not lost and printing durability is not diminished. Moreover, while the specifically designed apparatus described in US '993 using ozone filters provided an advance in the art, there is a need to solve the problem by redesign of the precursors themselves.

SUMMARY OF THE INVENTION

The present invention provides a lithographic printing plate precursor comprising a substrate, and one or more infrared radiation-sensitive image-recording layers disposed on the substrate, the lithographic printing precursor further comprising one or more infrared radiation absorbers and an ozone-blocking material in at least one of the one or more infrared radiation-sensitive image-recording layers, which ozone-blocking material has a molecular weight of 1500 or less and is represented by the following structure (I), (II), or (III):

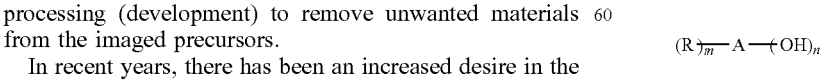

(I)

wherein R is a hydrocarbon group having 14 to 30 carbon atoms; m is 1 or 2; n is 1 to 6; the sum of m and n is greater than 2 and less than 8; and A is a multivalent organic moiety that is free of R and OH groups, and A has a valence equal to the sum of m and n;

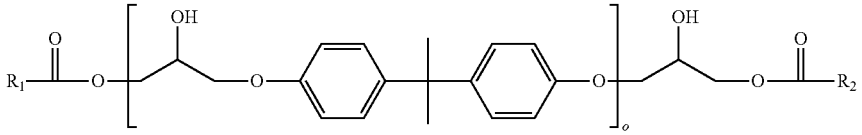

wherein $R_1$ and $R_2$ are independently alkyl groups having 14 to 22 carbon atoms, and o is an integer of 1 to 3; and $$R_3C(=O)NR_4R_5 \quad \text{(III)}$$

wherein $R_3$ is an alkenyl group comprising at least one C=C double bond within a carbon-carbon chain having 16 to 30 carbon atoms, and $R_4$ and $R_5$ are independently a hydrogen atom or an unsubstituted alkyl group having 1 to 4 carbon atoms.

In addition, the present invention provides a method for providing a lithographic printing plate, comprising:

A) imagewise exposing the lithographic printing plate precursor according to any embodiment of the present invention to imaging infrared radiation, to provide exposed regions and non-exposed regions in the one or more infrared radiation-sensitive image-recording layers, and B) removing either the exposed regions or the non-exposed regions in the one or more infrared radiation-sensitive image-recording layers from the substrate.

The present invention overcomes the noted problems caused by ambient ozone by the incorporation of an ozone-blocking material into an infrared radiation-sensitive image-recording layer. This ozone-blocking material present in the infrared radiation-sensitive image-recording layer provides excellent resistance of the infrared dyes against degradation and thus improves the operator's ability to maintain imaging speed (sensitivity) in the presence of ambient ozone. While not being limited to a particular mechanistic understanding of the present invention, it is believed that the ozone-blocking material used according to the present invention forms an ozone-blocking barrier layer either at the surface of the image-recording layer through self-stratification or forms an ozone-blocking micellar membrane around infrared dye molecules. In addition, the ozone-blocking material used according to the present invention was found to be compatible with on-press developable lithographic printing plate precursors such that on-press developability was not negatively affected or compromised by its presence in the image-recording layer.

DETAILED DESCRIPTION OF THE INVENTION

The following discussion is directed to various embodiments of the present invention and while some embodiments can be desirable for specific uses, the disclosed embodiments should not be interpreted or otherwise considered to limit the scope of the present invention, as claimed below. In addition, one skilled in the art will understand that the following disclosure has broader application than is explicitly described in the discussion of any specific embodiment.

Definitions

As used herein to define various components of the infrared radiation-sensitive image-recording layer, and other layers or materials used in the practice of this invention, unless otherwise indicated, the singular forms "a," "an," and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term should be interpreted to have a standard dictionary meaning.

The use of numerical values in the various ranges specified herein, unless otherwise expressly indicated, are to be considered as approximations as though the minimum and maximum values within the stated ranges were both preceded by the word "about." In this manner, slight variations above and below the stated ranges may be useful to achieve substantially the same results as the values within the ranges. In addition, the disclosure of these ranges is intended as a continuous range including every value between the minimum and maximum values as well as the end points of the ranges.

Unless the context indicates otherwise, when used herein, the terms "lithographic printing plate precursor," "precursor," and "IR-sensitive lithographic printing plate precursor" are meant to be equivalent references to embodiments of the present invention.

As used herein, the term "infrared radiation absorber" refers to a compound or material that absorbs electromagnetic radiation in the near-infrared (near-IR) and infrared (IR) regions of the electromagnetic spectrum, and it typically refers to compounds or materials that have an absorption maximum in the near-IR and IR regions.

As used herein, the terms "near-infrared region" and "infrared region" refer to radiation having a wavelength of at least 750 nm and higher. In most instances, the terms are used to refer to the region of the electromagnetic spectrum of at least 750 nm and more likely of at least 800 nm and up to and including 1400 nm.

For clarification of definitions for any terms relating to polymers, reference should be made to "Glossary of Basic Terms in Polymer Science" as published by the International Union of Pure and Applied Chemistry ("IUPAC"), *Pure Appl. Chem.* 68, 2287-2311 (1996). However, any definitions explicitly set forth herein should be regarded as controlling.

As used herein, the term "polymer" is used to describe compounds with relatively large molecular weights formed by linking together many small reactive monomers to form recurring units of the same chemical composition. These polymer chains usually form coiled structures in a random fashion. With the choice of solvents, a polymer can become insoluble as the chain length grows and become polymeric particles dispersed in the solvent medium. These particle dispersions can be very stable and useful in infrared radiation-sensitive imageable layers described for use in the present invention. In this invention, unless indicated otherwise, the term "polymer" refers to a non-crosslinked material. Thus, crosslinked polymeric particles differ from the non-crosslinked polymeric particles in that the latter can be dissolved in certain organic solvents of good solvating property whereas the crosslinked polymeric particles may swell but do not dissolve in the organic solvent because the polymer chains are connected by strong covalent bonds.

The term "copolymer" refers to polymers composed of two or more different repeating or recurring units that are arranged along the polymer chain.

The term "backbone" refers to the chain of atoms in a polymer to which a plurality of pendant groups can be attached. An example of such a backbone is an "all carbon" backbone obtained from the polymerization of one or more ethylenically unsaturated polymerizable monomers.

As used herein, the term "ethylenically unsaturated polymerizable monomer" refers to a compound comprising one or more ethylenically unsaturated (—C═C—) bonds that are polymerizable using free radical or acid-catalyzed polymerization reactions and conditions. It is not meant to refer to chemical compounds that have only unsaturated —C═C— bonds that are not polymerizable under these conditions.

Unless otherwise indicated, the term "weight %" refers to the amount of a component or material based on the total solids of a composition, formulation, or layer. Unless otherwise indicated, the percentages can be the same for either a dry layer or the total solids of the formulation or composition.

As used herein, the term "layer" or "coating" can consist of one disposed or applied layer or a combination of several sequentially disposed or applied layers. If a layer is considered infrared radiation-sensitive and negative-working, it is both sensitive to infrared radiation (as described above for "infrared radiation-absorber") and negative-working in the formation of lithographic printing plates. If a layer is considered infrared radiation-sensitive and positive-working, it is both sensitive to infrared radiation (as described above for "infrared radiation-absorber) and positive-working in the formation of lithographic printing plates.

Uses

The lithographic printing plate precursors according to the present invention are useful for providing lithographic printing plates from either positive-working or negative-working imaging chemistry present in one or more infrared radiation-sensitive image-recording layers. These lithographic printing plates are useful for lithographic printing during press operations. Lithographic printing plates can be prepared using on-press or off-press processing according to this invention. The lithographic printing plate precursors are prepared with the structure and components described as follows.

Lithographic Printing Plate Precursors

The precursors according to the present invention can be formed by suitable application of one or more infrared radiation-sensitive image-recording compositions as described below to a suitable substrate (as described below) to form one or more infrared radiation-sensitive image-recording layers thereon. As defined in specific sections below, these compositions and layers, and resulting lithographic printing plate precursors can be designed to be either negative-working precursors or positive-working precursors. All of these precursors require the presence of a substrate.

Substrate:

The substrate that is used to prepare the precursors according to this invention generally has a hydrophilic imaging-side surface, or at least a surface that is more hydrophilic than the applied infrared radiation-sensitive image-recoding layer. The substrate generally comprises an aluminum-containing support that can be composed of raw aluminum or a suitable aluminum alloy that is conventionally used to prepare lithographic printing plate precursors.

The aluminum-containing substrate can be treated using techniques known in the art, including roughening of some type by physical (mechanical) graining, electrochemical graining, or chemical graining, which is followed by one or more anodizing treatments. Each anodizing treatment is typically carried out using either phosphoric or sulfuric acid and conventional conditions to form a desired hydrophilic aluminum oxide (or anodic oxide) layer on the aluminum-containing support. A single aluminum oxide (anodic oxide) layer can be present or multiple aluminum oxide layers having multiple pores with varying depths and shapes of pore openings can be present. Such processes thus provide an anodic oxide layer(s) underneath an infrared radiation-sensitive image-recording layer that can be provided as described below. A discussion of such pores and a process for controlling their width is described for example, in U.S. Patent Publications 2013/0052582 (Hayashi), 2014/0326151 (Namba et al.), and 2018/0250925 (Merka et al.), and U.S. Pat. No. 4,566,952 (Sprintschuik et al.), U.S. Pat. No. 8,789,464 (Tagawa et al.), U.S. Pat. No. 8,783,179 (Kurokawa et al.), and U.S. Pat. No. 8,978,555 (Kurokawa et al.), the disclosures of all of which are incorporated herein by reference, as well as in EP 2,353,882 (Tagawa et al.). Teaching about providing two sequential anodizing treatments to provide different aluminum oxide layers in an improved substrate are described for example, in U.S. Patent Application Publication 2018/0250925 (Merka et al.), the disclosure of which is incorporated herein by reference.

Sulfuric acid anodization of the aluminum support generally provides an aluminum (anodic) oxide weight (coverage) on the surface of at least 1 $g/m^2$ and up to and including 5 $g/m^2$ and more typically of at least 3 $g/m^2$ and up to and including 4 $g/m^2$. Phosphoric acid anodization generally provides an aluminum (anodic) oxide weight on the surface of from at least 0.5 $g/m^2$ and up to and including 5 $g/m^2$ and more typically of at least 1 $g/m^2$ and up to and including 3 $g/m^2$.

An anodized aluminum-containing support can be further treated to seal the anodic oxide pores or to hydrophilize its surface, or both, using known post-anodic treatment processes, such as post-treatments using aqueous solutions of one or more hydrophilic substances such as poly(vinyl phosphonic acid) (PVPA), vinyl phosphonic acid copolymers, poly[(meth)acrylic acid] or its alkali metal salts, or (meth)acrylic acid copolymers or their alkali metal salts, mixtures of phosphate and fluoride salts, or sodium silicate. The post-treatment process materials can also comprise unsaturated double bonds to enhance adhesion between the treated surface and the overlying infrared radiation exposed regions. Such unsaturated double bonds can be provided in low molecular weight materials or they can be present within side chains of polymers. Useful post-treatment processes include dipping the substrate with rinsing, dipping the substrate without rinsing, and various coating techniques such as extrusion coating.

In some embodiments, the hydrophilic layer comprises two components, that is: (1) a compound is defined as follows as having one or more ethylenically unsaturated polymerizable groups, one or more —OM groups at least one of which is connected directly to a phosphorus atom, and a molecular weight of less than 2000 Daltons/mole or less than 1500 Daltons/mole, wherein M represents a hydrogen, sodium, potassium, or aluminum atom; and (2) one or more hydrophilic polymers, each of which comprises at least (a) recurring units comprising an amide group, and (b)

recurring units comprising an —OM' group that is directly connected to a phosphorus atom, wherein M' is a hydrogen, sodium, potassium, or aluminum ion. M and M' can be the same or different atoms in a given hydrophilic layer formulation.

In some embodiments, the hydrophilic layer comprises one or more hydrophilic polymers, each of which comprises at least (a) recurring units comprising an amide group, and (b) recurring units comprising an —OM' group that is directly connected to a phosphorus atom, wherein M' is a hydrogen, sodium, potassium, or aluminum ion. M and M' can be the same or different atoms in a given hydrophilic layer formulation. To such hydrophilic layer formulations, inorganic acid such as phosphoric acid can be added.

An anodized aluminum-containing substrate can be treated with an alkaline or acidic pore-widening solution to provide an anodic oxide layer containing columnar pores. In some embodiments, the treated aluminum-containing substrate can comprise a hydrophilic layer disposed directly on a grained, anodized, and post-treated aluminum-containing support, and such hydrophilic layer can comprise a non-crosslinked hydrophilic polymer having carboxylic acid side chains.

The thickness of a substrate can be varied but, should be sufficient to sustain the wear from printing and thin enough to be wrapped around a printing form. Useful embodiments include a treated aluminum foil having a thickness of at least 100 μm and up to and including 700 μm. The backside (non-imaging side) of the substrate can be coated with antistatic agents, a slipping layer, or a matte layer to improve handling and "feel" of the precursor.

The substrate can be formed as a continuous roll (or continuous web) of sheet material that is suitably coated with an infrared radiation-sensitive image-recording layer formulation and optionally a hydrophilic protective layer formulation, followed by slitting or cutting (or both) to size to provide individual lithographic printing plate precursors having a shape or form having four right-angled corners (thus, typically in a square or rectangular shape or form). Typically, the cut individual precursors have a planar or generally flat rectangular shape.

Negative-Working Lithographic Printing Precursors

Negative-working lithographic printing plate precursors according to the present invention can be constructed using the following components and materials. Typically, each of these precursors has a substrate (as described above) on which is disposed a negative-working infrared radiation-sensitive image-recording layer comprising suitable chemistry for infrared radiation imaging and suitable processing to facilitate removal of non-exposed regions of the image-recording layer. For some negative-working lithographic printing plate precursors, a single negative-working infrared radiation-sensitive image-recording layer is present on the substrate.

The infrared radiation-sensitive image-recording layer composition (and infrared radiation-sensitive image-recording layer prepared therefrom) according to the present invention is designed to be "negative-working" as that term is known in the lithographic art. In addition, the infrared radiation-sensitive image-recording layer can be designed with a certain combination of components to provide on-press developability to the lithographic printing plate precursor after exposure, for example to enable development using a fountain solution, a lithographic printing ink, or a combination of the two.

Infrared Radiation Image-Recording Layer(s):

The precursors can be formed by suitable application of one or more infrared radiation-sensitive compositions as described below to a suitable substrate (as described above) to form one or more infrared radiation-sensitive image-recording layers on that substrate, each of which is generally negative-working. In general, at least one infrared radiation-sensitive image-recording layer comprises: one or more ozone-blocking materials as defined below; one or more infrared radiation absorbers; and for negative-working precursors, a) one or more free radically polymerizable components; and b) an initiator composition that provides free radicals upon exposure of the negative-working infrared radiation-sensitive image-recording layer to imaging infrared radiation, as essential components, and optionally, one or more non-free radically polymerizable polymeric materials that are different from all of the a), b), infrared radiation absorbers, and ozone blocking materials. All of these essential and optional components are described in more detail below. Such infrared radiation-sensitive image-recording layer can be generally the outermost layer in the precursor.

An essential component of the one or more infrared radiation-sensitive image-recording layers is an ozone-blocking material having a molecular weight of at least 200 and up to and including 1500, and more likely of at least 250 and up to and including 1200. Combinations of two or more such ozone-blocking materials from different classes of compounds can also be used.

More specifically, each of the useful ozone-blocking materials can be represented by the following structure (I), (II), or (III):

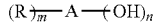

(I)

wherein R is a hydrocarbon group having at least 14 and up to and including 30 carbon atoms; m is 1 or 2; n is 1 to 6, the sum of m and n is greater than 2 (or greater than 3) but less than 8; and A is a multivalent organic moiety that is free of R and OH groups, and A has a valence equal to the sum of m and n;

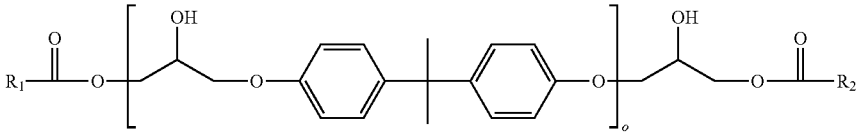

(II)

wherein $R_1$ and $R_2$ are independently alkyl groups having 14 to 22 carbon atoms, and o is an integer of 1 to 3; and

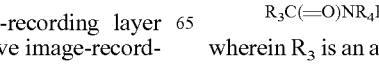

(III)

wherein $R_3$ is an alkenyl group comprising at least one C=C double bond within a carbon-carbon chain having 16 to 30 carbon atoms, and $R_4$ and $R_5$ are independently a hydrogen atom or an unsubstituted alkyl group having 1-4 carbon atoms.

More specifically, R can be a hydrocarbon group having at least 14 and up to and including 30 carbon atoms, or even having at least 16 and up to and including 22 carbon atoms. Useful hydrocarbon groups comprise only hydrogen and carbon atoms in each moiety and can include linear or branched moieties or cyclic moieties having one or more fused non-aromatic rings. Examples of useful hydrocarbon groups include but are not limited to linear or branched alkyl groups, cycloalkyl groups, linear or branched alkenyl groups, and linear or branched alkynyl groups. Particularly useful hydrocarbon groups are linear or branched alkyl groups.

The multivalent "A" moiety is not particularly limited as long as it provides enough valences to link the R groups and OH groups and it is small enough to keep the molecular weight of the ozone-blocking material within the specified range as defined above. It is an organic moiety comprising carbon and hydrogen as essential atoms. It can also comprise hetero atoms such as oxygen, sulfur, nitrogen, and halogen atoms, in any suitable combination thereof.

As noted above, a mixture ozone-blocking materials can be used that include one or more compounds represented by each of structures (I), (II), and (III).

Some useful ozone-blocking materials that fall within Structure (I), (II), or (III) include the following materials that can be used singly or in combinations of two or more:

sorbitan monostearate, sorbitan mono-palmitate, sorbitan mono-myristate, sorbitan mono-behenate, sorbitan distearate, sorbitan dipalmitate, sorbitol dimyristate, sorbitan dibehenate, glycerol monostearate, glycerol mono-palmitate, glycerol mono-myristate, glycerol mono-behenate, oleamide, erucamide, and compounds represented by the following structure (II):

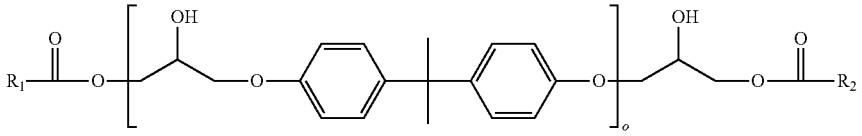

(II)

wherein $R_1$ and $R_2$ are independently unsubstituted alkyl groups (cyclic, linear, or branched groups) having at least 14 and up to and including 22 carbon atoms, and "o" is an integer of 1 to 3 (or 1 to 2).

In most embodiments, the one or more ozone-blocking materials according to structure (I), (II), or (III) and the one or more infrared radiation absorbers are placed together at least in an outermost infrared radiation-sensitive image-recording layer present in the lithographic printing plate precursor. However, it is possible that one or more of the infrared radiation absorbers or one or more of the ozone-blocking materials can be located in multiple layers, as long as at least one infrared radiation absorber and at least one ozone-blocking material is located in an outermost infrared radiation-sensitive image-recording layer. Typically this outermost layer can be a negative-working infrared radiation-sensitive image-recording layer, or it can be an outermost positive-working infrared radiation-sensitive image-recording layer (as described below).

The one or more ozone-blocking materials according to structure (I), (II), or (III) can be present in the precursors, for example at each of one of the one or more infrared radiation-sensitive image-recording layers (such as a negative-working infrared radiation-sensitive image-recording layer) in an amount of at least 1 weight % or of at least 2 weight %, and up to and including 10 weight %, or up to and including 15 weight %, all based on the total solids of each of the one of the one or more infrared radiation-sensitive image-recording layers. In most embodiments, these amounts represent the total amount of ozone blocking materials in a precursor, no matter whether they are distributed within a single image-recording layer or within multiple image-recording layers.

The ozone-blocking materials according to structure (I), (II), or (III) can be provided by routine synthetic methods known in the art using known starting materials, or they can be obtained from various commercial sources as noted below for the working examples.

In addition, at least one infrared radiation-sensitive image-recording layers comprises one or more infrared radiation absorbers to provide desired infrared radiation sensitivity or to convert radiation to heat, or both. Useful infrared radiation absorbers can be pigments or infrared radiation absorbing dyes. Suitable dyes are those described in for example, U.S. Pat. No. 5,208,135 (Patel et al.), U.S. Pat. No. 6,153,356 (Urano et al.), U.S. Pat. No. 6,309,792 (Hauck et al.), U.S. Pat. No. 6,569,603 (Furukawa), U.S. Pat. No. 6,797,449 (Nakamura et al.), U.S. Pat. No. 7,018,775 (Tao), U.S. Pat. No. 7,368,215 (Munnelly et al.), U.S. Pat. No. 8,632,941 (Balbinot et al.), and U.S. Patent Application Publication 2007/056457 (Iwai et al.), the disclosures of all of which are incorporated herein by reference. In some embodiments, it is useful that at least one infrared radiation absorber in a negative-working infrared radiation-sensitive image-recording layer is a cyanine dye comprising a suitable cationic cyanine chromophore and a tetraarylborate anion such as a tetraphenylborate anion. Examples of such dyes include those described in United States Patent Application Publication 2011/003123 (Simpson et al.), the disclosure of which is incorporated herein by reference.

In addition to low molecular weight IR-absorbing dyes, IR dye chromophores bonded to polymers can be used as well. Moreover, IR dye cations can be used as well, that is, the cation is the IR absorbing portion of the dye salt that ionically interacts with a polymer comprising carboxy, sulfo, phospho, or phosphono groups in the side chains.

The total amount of the one or more infrared radiation absorbers is at least 0.5 weight % or at least 1 weight %, and up to and including 15 weight %, or up to and including 30 weight %, based on the total dry coverage of the at least one or more negative-working infrared radiation-sensitive image-recording layers. As described above for the ozone-blocking materials, the noted amount of one or more infrared radiation absorbers can be present in a single or multiple infrared radiation-sensitive image-recording layers, and the noted amount can be total amount in the precursor.

Useful infrared radiation absorbers can be obtained from various commercial sources in the world, or they can be prepared using known chemical synthetic methods and starting materials as a skilled synthetic chemist would be able to carry out.

Particularly useful negative-working lithographic printing plate precursors according to the present invention comprise a negative-working infrared radiation-sensitive image-recording layer comprising the noted one or more ozone-blocking materials according to structure (I), (II) or (III), and the one or more infrared radiation absorbers, and further comprising:

a) one or more free radically polymerizable components; and b) an initiator composition capable of generating free radicals, and the negative-working infrared radiation-sensitive image-recording layer, can optionally further comprise one or more non-free radically polymerizable polymeric materials that are different from the a), b), infrared radiation absorbers, and the ozone blocking materials defined above.

Thus, a negative-working infrared radiation-sensitive image-recording layer used in the practice of the present invention can comprise a) one or more free radically polymerizable components, each of which contains one or more free radically polymerizable groups that can be polymerized using free radical initiation during infrared radiation exposure. In some embodiments, at least two free radically polymerizable components, having the same or different numbers of free radically polymerizable groups in each molecule, are present. Thus, useful free radically polymerizable components can contain one or more free radical polymerizable monomers or oligomers having one or more polymerizable ethylenically unsaturated groups (for example, two or more of such groups). Similarly, crosslinkable polymers having such free radically polymerizable groups can also be used. Oligomers or prepolymers, such as urethane acrylates and methacrylates, epoxide acrylates and methacrylates, polyester acrylates and methacrylates, polyether acrylates and methacrylates, and unsaturated polyester resins can be used. In some embodiments, the free radically polymerizable component comprises carboxyl groups.

It is possible for a) one or more free radically polymerizable components to have large enough molecular weight or to have sufficient polymerizable groups to provide a crosslinkable polymer matrix that functions as a "polymeric binder" for other components in the negative-working infrared radiation-sensitive image-recording layer. In such embodiments, a distinct non-free radically polymerizable polymer material (described below) is not necessary but can still be present if desired.

Useful free radically polymerizable components include urea urethane (meth)acrylates or urethane (meth)acrylates having multiple (two or more) polymerizable groups. Mixtures of such compounds can be used, each compound having two or more unsaturated polymerizable groups, and some of the compounds having three, four, or more unsaturated polymerizable groups. For example, a free radically polymerizable component can be prepared by reacting DESMODUR® N100 aliphatic polyisocyanate resin based on hexamethylene diisocyanate (Bayer Corp., Milford, Conn.) with hydroxyethyl acrylate and pentaerythritol triacrylate. Useful free radically polymerizable compounds include NK Ester A-DPH (dipentaerythritol hexaacrylate) that is available from Kowa American, and Sartomer SR399 (dipentaerythritol pentaacrylate), Sartomer SR355 (di-trimethylolpropane tetraacrylate), Sartomer SR295 (pentaerythritol tetraacrylate), and Sartomer SR415 [ethoxylated (20)trimethylolpropane triacrylate] that are available from Sartomer Company, Inc.

Numerous other useful free radically polymerizable components are known in the art and are described in considerable literature including *Photoreactive Polymers: The Science and Technology of Resists*, A Reiser, Wiley, New York, 1989, pp. 102-177, by B. M. Monroe in *Radiation Curing: Science and Technology*, S. P. Pappas, Ed., Plenum, New York, 1992, pp. 399-440, and in "Polymer Imaging" by A. B. Cohen and P. Walker, in *Imaging Processes and Material*, J. M. Sturge et al. (Eds.), Van Nostrand Reinhold, New York, 1989, pp. 226-262. For example, useful free radically polymerizable components are also described in EP 1,182,033A1 (Fujimaki et al.), beginning with paragraph [0170], and in U.S. Pat. No. 6,309,792 (Hauck et al.), U.S. Pat. No. 6,569,603 (Furukawa), and U.S. Pat. No. 6,893,797 (Munnelly et al.) the disclosures of all of which are incorporated herein by reference. Other useful free radically polymerizable components include those described in U.S. Patent Application Publication 2009/0142695 (Baumann et al.), which radically polymerizable components include 1H-tetrazole groups, and the disclosure of which publication is incorporated herein by reference.

The a) one or more free radically polymerizable components are generally present in an amount of at least 10 weight % or of at least 20 weight %, and up to and including 50 weight %, or up to and including 70 weight %, all based on the total dry coverage of the negative-working infrared radiation-sensitive image-recording layer.

Useful free radically polymerizable components can be obtained from various commercial sources in the world, or they can be readily prepared using known starting materials and synthetic methods carried out by skilled synthetic chemists.

Moreover, the present invention can utilize an b) initiator composition that is present in a negative-working infrared radiation-sensitive image-recording layer. Such initiator compositions can comprise one or more organohalogen compounds, for example trihaloallyl compounds; halomethyl triazines; bis(trihalomethyl) triazines; and onium salts such as iodonium salts, sulfonium salts, diazonium salts, phosphonium salts, and ammonium salts, many of which are known in the art. For example, representative compounds other than onium salts are described for example in [0087] to [0102] of U.S. Patent Application Publication 2005/0170282 (Inno et al., US '282) and U.S. Pat. No. 6,309,792 (Hauck et al.), the disclosures of both of which are incorporated herein by reference including the numerous cited publications describing such compounds, and also in Japanese Patent Publication 2002/107916 and WO 2019/179995.

Useful onium salts are described for example from [0103] to of the cited US '282. For example, useful onium salts comprise least one onium cation in the molecule, and a suitable anion. Examples of the onium salts include triphenylsulfonium, diphenyliodonium, diphenyldiazonium, compounds and derivatives thereof that are obtained by introducing one or more substituents into the benzene ring of these compounds. Suitable substituents include but are not limited to, alkyl, alkoxy, alkoxycarbonyl, acyl, acyloxy, chloro, bromo, fluoro and nitro groups.

Examples of anions in onium salts include but are not limited to, halogen anions, $ClO_4^-$, $PF_6^-$, $BF_4^-$, $SbF_6^-$, $CH_3SO_3^-$, $CF_3SO_3^-$, $C_6H_5SO_3^-$, $CH_3C_6H_4SO_3^-$, $HOC_6H_4SO_3^-$, $ClC_6H_4SO_3^-$, and boron anions (such as tetraaryl borate anions) as described for example in U.S. Pat.

No. 7,524,614 (Tao et al.), the disclosure of which is incorporated herein by reference.

Representative useful iodonium salts are described in U.S. Pat. No. 7,524,614 (noted above), in Cols. 6-7 wherein the iodonium cation can contain various listed monovalent substituents "X" and "Y," or fused carbocyclic or heterocyclic rings with the respective phenyl groups.

Useful onium salts can be polyvalent onium salts having at least two onium ions in the molecule that are bonded through a covalent bond. Among polyvalent onium salts, those having at least two onium ions in the molecule are useful and those having a sulfonium or iodonium cation in the molecule are useful.

Furthermore, the onium salts described in paragraphs [0033] to of the specification of Japanese Patent Publication 2002-082429 [or U.S. Patent Application Publication 2002-0051934 (Ippei et al.)], the disclosure of which is incorporated herein by reference] or the iodonium borate complexes described in U.S. Pat. No. 7,524,614 (noted above), in Cols. 6 and 7 can also be used.

Representative iodonium borate salts are for example, listed in Col. 8 of U.S. Pat. No. 7,524,614 (noted above). Such iodonium borate salts can include a borate anion represented by the following structure:

$$B^+(R^1)(R^2)(R^3)(R^4)^-$$

wherein $R^1$, $R^2$, $R^3$, and $R^4$ independently represent substituted or unsubstituted alkyl, aryl, alkenyl, alkynyl, cycloalkyl, or heterocyclic groups each attached to the boron atom, or two or more of $R^1$, $R^2$, $R^3$, and $R^4$ can be joined together to form a heterocyclic ring with the boron atom, such heterocyclic rings each having up to 7 carbon, nitrogen, oxygen, or sulfur atoms. For example, tetraaryl borate anions including tetraphenyl borate, and triarylalkyl borate such as triphenylalkyl borate compounds are useful.

In some embodiments, a combination of onium salts can be used as part of the initiator composition, such as for example a combination of compounds described as Compounds A and Compounds B in U.S. Patent Application Publication 2017/0217149 (Hayashi et al.), the disclosure of which is incorporated herein by reference.

Since the b) initiator composition can have multiple components, it would be readily apparent to one skilled in the art as to the useful amount(s) or dry coverage of the various components of the b) initiator composition in the negative-working infrared radiation-sensitive image-recording layer, based on the knowledge of a skilled artisan and the representative teaching provided herein including the working Examples shown below. Useful b) initiator composition materials can be readily obtained from commercial sources in the world, or readily prepared using known starting materials and synthetic methods carried out by a skilled synthetic chemist.

It is optional but desirable in some embodiments that a negative-working infrared radiation-sensitive image-recording layer further comprises one or more non-free radically polymerizable polymeric materials (or polymeric binders), each of which does not have any functional groups that, if present, would make the polymeric material capable of free radical polymerization. Thus, such non-free radically polymerizable polymeric materials are different from the a) one or more free radically polymerizable components described above, and they are different materials from all of the b), infrared radiation absorbers, and ozone blocking materials described above.

Useful non-free radically polymerizable polymeric materials generally have a weight average molecular weight (Mw) of at least 2,000, or of at least 20,000, and up to and including 300,000 or up to and including 500,000, as determined by Gel Permeation Chromatography (polystyrene standard).

Such non-free radically polymerizable polymeric materials can be selected from polymeric binder materials known in the art including polymers comprising recurring units having side chains comprising polyalkylene oxide segments such as those described in for example, U.S. Pat. No. 6,899,994 (Huang et al.) the disclosure of which is incorporated herein by reference. Other useful polymeric binders comprise two or more types of recurring units having different side chains comprising polyalkylene oxide segments as described in for example WO Publication 2015-156065 (Kamiya et al.). Some of such polymeric binders can further comprise recurring units having pendant cyano groups as those described in for example U.S. Pat. No. 7,261,998 (Hayashi et al.), the disclosure of which is incorporated herein by reference.

Such polymeric binders also can have a backbone comprising multiple (at least two) urethane moieties as well as pendant groups comprising the polyalkylenes oxide segments.

Some useful non-free radically polymerizable polymeric materials, can be present in particulate form, that is, in the form of discrete particles (non-agglomerated particles). Such discrete particles can have an average particle size of at least 10 nm and up to and including 1500 nm, or typically of at least 80 nm and up to and including 600 nm, and that are generally distributed uniformly within the negative-working infrared radiation-sensitive image-recording layer. Some of these materials can be present in particulate form and have an average particle size of at least 50 nm and up to and including 400 nm. Average particle size can be determined using various known methods and nanoparticle measuring equipment, including measuring the particles in electron scanning microscope images and averaging a set number of measurements.

In some embodiments, the non-free radically polymerizable polymeric material can be present in the form of particles having an average particle size that is less than the average dry thickness (t) of the negative-working infrared radiation-sensitive image-recording layer. The average dry thickness (t) in micrometers (μm) is calculated by the following Equation:

$$t=w/r$$

wherein w is the dry coating coverage of the negative-working infrared radiation-sensitive image-recording layer in $g/m^2$ and r is 1 $g/cm^3$.

The non-free radically polymerizable polymeric material(s) can be present in an amount of at least 10 weight %, or at least 20 weight %, and up to and including 50 weight %, or up to and including 70 weight %, based on the total dry coverage of the negative-working infrared radiation-sensitive image-recording layer.

Useful non-free radically polymerizable polymeric materials can be obtained from various commercial sources or they can be prepared using known procedures and starting materials, as described for example in publications described above and as known by skilled polymer chemists.

The negative-working infrared radiation-sensitive image-recording layer can optionally include crosslinked polymer particles, such materials having an average particle size of at least 2 μm, or of at least 4 μm, and up to and including 20 μm as described for example in U.S. Pat. No. 9,366,962 (Hayakawa et al.), U.S. Pat. No. 8,383,319 (Huang et al.)

and U.S. Pat. No. 8,105,751 (Endo et al), the disclosures of all of which are incorporated herein by reference. Such crosslinked polymeric particles can be present in the hydrophilic protective layer when present (described below), or in both the negative-working infrared radiation-sensitive image-recording layer and the hydrophilic protective layer when present.

The negative-working infrared radiation-sensitive image-recording layer can also include a variety of other optional addenda including but not limited to, dispersing agents, humectants, biocides, plasticizers, surfactants for coatability or other properties, viscosity builders, pH adjusters, drying agents, defoamers, development aids, rheology modifiers, or combinations thereof, or any other addenda commonly used in the lithographic coating art, in conventional amounts. The negative-working infrared radiation-sensitive image-recording layer can also include a phosphate (meth)acrylate having a molecular weight generally greater than 250 as described in U.S. Pat. No. 7,429,445 (Munnelly et al.) the disclosure of which is incorporated herein by reference.

Moreover, the negative-working infrared radiation-sensitive image-recording layer can optionally comprise one or more suitable chain transfer agents, antioxidants, or stabilizers to prevent or moderate undesired radical reactions. Suitable antioxidants and inhibitors for this purpose are described, for example in [0144] to [0149] of EP 2,735,903B1 (Werner et al.) and in Cols. 7-9 of U.S. Pat. No. 7,189,494 (Munnelly et al.), the disclosure of which is incorporated herein by reference.

The useful dry coverage of a negative-working infrared radiation-sensitive image-recording layer is described below.

Protective Layer:

While the present invention is most useful for lithographic printing plate precursors having a negative-working infrared radiation-sensitive image-recording layer as the outermost layer, the precursors according to this invention can be designed with a protective layer disposed on the infrared radiation-sensitive image-recording layer. The protective layer is typically hydrophilic, but it can also be hydrophobic or comprise hydrophobic ingredients such as those described in PCT patent application publication WO2019/243036A1. In such precursors, the ozone-blocking material in the infrared sensitive image-recording layer can still be beneficial, particularly for those precursors where the protective layer does not provide adequate protection of the infrared sensitive-image recording layer against ambient ozone. On the other hand, typical protective layers that contain polyvinyl alcohol as main binder and function as an oxygen barrier layer to reduce oxygen inhibition in the underlying free radically crosslinkable composition may have some ozone blocking capability and can contain some of the ozone blocking material according to Structure (I), (II) or (III) of the present invention.

However, for the purpose of protecting an infrared radiation sensitive image-recording layer according to the present invention, the use of ozone-blocking material of Structure (I), (II), or (III) according to the present invention is advantageous over traditional oxygen-blocking hydrophilic layer in that the latter can have undesirable effects, especially for lithographic printing plate precursors designed for on-press development using a lithographic ink, a fountain solution, or both a lithographic ink and a fountain solution. The potential undesirable effects include slow ink rollup, contamination of the fountain solution and reduced image durability due to uncontrolled intermixing between the hydrophilic protective layer and the infrared radiation sensitive image-recording layer.

Preparing Negative-Working Lithographic Printing Plate Precursors:

Negative-working lithographic printing plate precursors according to the present invention can be provided in the following manner. An infrared radiation-sensitive image-recording layer formulation comprising components described above including one or more ozone-blocking materials and one or more infrared radiation absorbers, and other addenda described above, dissolved or dispersed in a suitable solvent, can be applied to a hydrophilic surface of a suitable aluminum-containing substrate as described above, using any suitable equipment and procedure, such as spin coating, knife coating, gravure coating, die coating, slot coating, bar coating, wire rod coating, roller coating, or extrusion hopper coating. Such formulation can also be applied by spraying onto a suitable substrate. Typically, once the infrared radiation-sensitive image-recording layer formulation is applied at a suitable wet coverage, it is dried in a suitable manner known in the art to provide a desired dry coverage as noted below.

A solvent suitable for preparing such precursors according to the present invention can be comprised of water and/or one or more organic solvents. Examples of useful organic solvents include methyl ethyl ketone (2-butanone), methanol, ethanol, 1-methoxy-2-propanol, 2-methoxypropanol, iso-propyl alcohol, acetone, γ-butyrolactone, n-propanol, tetrahydrofuran, and others readily known in the art.

After proper drying, the dry coverage of each of the at least one or more infrared radiation-sensitive image-recording layers on the substrate is generally at least 0.1 $g/m^2$, or at least 0.4 $g/m^2$, and up to and including 2 $g/m^2$ or up to and including 4 $g/m^2$ but other dry coverage amounts can be used if desired.

As described above, in some embodiments, a suitable protective layer formulation (described above) can be applied to the dried infrared radiation-sensitive image-recording layer using known coating and drying conditions, equipment, and procedures.

In practical manufacturing conditions, the result of these coating operations is a continuous radiation-sensitive web (or roll) of infrared radiation-sensitive lithographic printing plate precursor material having an infrared radiation-sensitive image-recording layer and optionally a protective layer. Such continuous radiation-sensitive web can be slit or cut into appropriately sized precursors for use.

Positive-Working Lithographic Printing Plate Precursors

Positive-working lithographic printing plate precursors according to the present invention can comprise one or more infrared radiation-sensitive image-recording layers disposed on a suitable substrate having a hydrophilic surface. Such precursors can have a single infrared radiation-sensitive image-recording layer along with optional underlying layers that are non-radiation-sensitive, or they can have two or more infrared radiation-sensitive image-recording layers (sometimes known as innermost and outermost infrared radiation sensitive layers or "ink-receptive" layers) along with optional underlayers and intermediate layers. Such infrared radiation-sensitive image-recording layers are typically "sensitive" to near-infrared radiation exposure as defined herein, and such exposure makes exposed regions of such layers more soluble or dispersible in a suitable processing solution, so that the chemical materials in such regions can be readily removed during processing (development).

The chemical compositions and useful components of the various infrared radiation-sensitive image-recording layers for such precursors, and materials and means for preparing such precursors, are well known from considerable patent literature including, but not limited to, U.S. Pat. No. 8,088,549 (Levanon et al.), U.S. Pat. No. 8,530,143 (Levanon et al.), and U.S. Pat. No. 8,936,899 (Hauck et al.), and U.S. Patent Application Publications 2012/0270152 (Hauck et al.) and 2017/0068164 (Huang et al.), the disclosures of all of which are incorporated herein by reference with respect to the composition and formation of positive-working lithographic printing plate precursors.

Imaging (Exposing) Conditions

During use, an infrared radiation-sensitive lithographic printing plate precursor of this invention can be exposed to a suitable source of infrared radiation depending upon the infrared radiation absorber(s) present in the one or more infrared radiation-sensitive image-recording layers. In some embodiments, the lithographic printing plate precursors can be imaged with one or more lasers that emit significant infrared radiation within the range of at least 750 nm and up to and including 1400 nm, or of at least 800 nm and up to and including 1250 nm to create exposed regions and non-exposed regions in the one or more infrared radiation-sensitive image-recording layers. Such infrared radiation-emitting lasers can be used for such imaging in response to digital information supplied by a computing device or other source of digital information. The laser imaging can be digitally controlled in a suitable manner known in the art.

Thus, imaging can be carried out using imaging or exposing infrared radiation from an infrared radiation-generating laser or from an array of such lasers. Imaging also can be carried out using imaging radiation at multiple infrared (or near-IR) wavelengths at the same time if desired. The laser(s) used to expose the precursor is usually a diode laser(s), because of the reliability and low maintenance of diode laser systems, but other lasers such as gas or solid-state lasers can also be used. The combination of power, intensity and exposure time for infrared radiation imaging would be readily apparent to one skilled in the art.

The infrared imaging apparatus can be configured as a flatbed recorder or as a drum recorder, with the infrared radiation-sensitive lithographic printing plate precursor mounted to the interior or exterior cylindrical surface of the drum. An example of useful imaging apparatus is available as models of KODAK® Trendsetter platesetters (Eastman Kodak Company) and NEC AMZISetter X-series (NEC Corporation, Japan) that contain laser diodes that emit radiation at a wavelength of about 830 nm. Other suitable imaging apparatus includes the Screen PlateRite 4300 series or 8600 series platesetters (available from Screen USA, Chicago, Ill.) or thermal CTP platesetters from Panasonic Corporation (Japan) that operates at a wavelength of 810 nm.

When an infrared radiation imaging source is used, imaging energy intensities can be at least 30 mJ/cm$^2$ and up to and including 500 mJ/cm$^2$ and typically at least 50 mJ/cm$^2$ and up to and including 300 mJ/cm$^2$ depending upon the sensitivity of one or more the infrared radiation-sensitive image-recording layers.

Both positive-working lithographic printing plate precursors and negative-working lithographic printing plate precursors according to the present invention can be imaged using this teaching, and a skilled worker would understand the appropriate imaging apparatus and energy for each type of precursor.

Processing (Development) and Printing

After imagewise exposing as described above, the exposed infrared radiation-sensitive lithographic printing plate precursors having exposed regions and non-exposed regions in the infrared radiation-sensitive image-recording layer can be processed either off-press or on-press to remove the non-exposed regions (and any protective layer over such regions) for exposed negative-working infrared radiation-sensitive lithographic printing plate precursors, and to remove the exposed regions of one or more layers for exposed positive-working infrared radiation-sensitive lithographic printing plate precursors.

After this processing, and during lithographic printing, the revealed hydrophilic substrate surface repels inks while the remaining exposed (or non-exposed) regions accept lithographic printing ink.

Off-Press Development and Printing:

Processing of both positive-working and negative-working precursors can be carried out off-press using any suitable developer in one or more successive applications (treatments or developing steps) of the same or different processing solution (developer). Such one or more successive processing treatments can be carried out for a time sufficient to remove the either the non-exposed regions of the infrared radiation-sensitive image-recording layer (for exposed negative-working precursors) or the exposed regions (for exposed positive-working precursors) to reveal the outermost hydrophilic surface of the substrate, but not long enough to remove significant amounts of the regions that are to remain on the substrate.

Prior to such off-press processing, the exposed precursors can be subjected to a "pre-heating" process to further harden the exposed regions in a negative-working infrared radiation-sensitive image-recording layer. Such optional pre-heating can be carried out using any known process and equipment generally at a temperature of at least 60° C. and up to and including 180° C.

Following this optional pre-heating, or in place of the pre-heating, the exposed precursor can be washed (rinsed) to remove any hydrophilic overcoat that is present. Such optional washing (or rinsing) can be carried out using any suitable aqueous solution (such as water or an aqueous solution of a surfactant) at a suitable temperature and for a suitable time that would be readily apparent to one skilled in the art.

One or more successive treatments with the processing solution off-press can be accomplished using what is known as "manual" development, or processing with an automatic development apparatus (processor) using one or more processing stations. In the case of "manual" development, processing can be conducted by rubbing the entire imagewise exposed precursor with a sponge or cotton pad sufficiently impregnated with the processing solution (as described below) or dipping the imagewise exposed precursor in a tank or tray containing a processing solution for at least 10 seconds and up to and including 60 seconds (especially at least 20 seconds and up to and including 40 seconds) under agitation. The use of automatic development apparatus is well known and generally includes pumping a processing solution into a developing tank or ejecting it from spray nozzles. The apparatus can also include a suitable mechanical rubbing mechanism (for example one or more brushes, rollers, or squeegees) and a suitable number of conveyance rollers. Manual processing is less desirable than the use of a processing apparatus of some type.

Useful developers can be ordinary water or formulated aqueous solutions. The particular developer to be used can be chosen by a skilled worker in the art based on the type of precursor that was imaged. Thus, imaged positive-working precursors can be developed with processing solutions that are different from those used to process imaged negative-working precursors. Some processing solutions useful for both types of precursors are described for example in U.S. Ser. No. 62/964,207 (filed on Jan. 22, 2020 by Werner et al.).

In some instances, an aqueous processing solution can be used off-press to both develop the imaged precursor by removing the non-exposed regions and also to provide a protective layer or coating over the entire imaged and developed (processed) negative-working precursor printing surface. In this embodiment the aqueous solution behaves somewhat like a gum that is capable of protecting (or "gumming") the lithographic image on the lithographic printing plate against contamination or damage (for example, from oxidation, fingerprints, dust, or scratches).

After the described off-press processing and optional drying, the resulting lithographic printing plate can be mounted onto a printing press without any contact with additional solutions or liquids. It is optional to further bake the lithographic printing plate with or without blanket or flood-wise exposure to UV or visible radiation.

Printing can be carried out by applying a lithographic printing ink and a fountain solution to the printing surface of the lithographic printing plate in a suitable manner. The fountain solution is taken up by the hydrophilic surface of the substrate revealed by the exposing and processing steps, and the lithographic ink is taken up by the remaining (exposed or non-exposed) regions of the one or more infrared radiation-sensitive image-recording layers. The lithographic ink is then transferred to a suitable receiving material (such as cloth, paper, metal, glass, or plastic) to provide a desired impression of the image thereon. If desired, an intermediate "blanket" roller can be used to transfer the lithographic ink from the lithographic printing plate to the receiving material (for example, sheets of paper).

On-Press Development and Printing:

Some negative-working lithographic printing plate precursors of the present invention, containing one or more ozone-blocking materials and one or more infrared radiation absorbers in a negative-working infrared radiation-sensitive image-recording layer, are on-press developable using a lithographic printing ink, a fountain solution, or a combination of a lithographic printing ink and a fountain solution. In such embodiments, an imaged (exposed) infrared radiation-sensitive lithographic printing plate precursor according to the present invention is mounted onto a printing press and the printing operation is begun. The non-exposed regions in the infrared radiation-sensitive image-recording layer are removed by a suitable fountain solution, lithographic printing ink, or a combination of both, when the initial printed impressions are made. Typical ingredients of aqueous fountain solutions include pH buffers, desensitizing agents, surfactants and wetting agents, humectants, low boiling solvents, biocides, antifoaming agents, and sequestering agents. A representative example of a fountain solution is yarn Litho Etch 142W+Varn PAR (alcohol sub) (available from yarn International, Addison, Ill.).

In a typical printing press startup with a sheet-fed printing machine, the dampening roller is engaged first and supplies fountain solution to the mounted imaged precursor to swell the exposed infrared radiation-sensitive image-recording layer at least in the non-exposed regions. After a few revolutions the inking rollers are engaged and they supply lithographic printing ink(s) to the entire printing surface of the lithographic printing plates. Typically, within 5 to 20 revolutions after the inking roller engagement, printing sheets are supplied to start lithographic printing. The initial press sheets may carry some inks or the infrared radiation-sensitive image-recording layer from the lithographic printing plate in the non-exposed regions. The removal of the one or more infrared radiation-sensitive image-recording layers from the non-exposed regions can be progressing from the engagement of the dampening rollers until the non-exposed regions of the lithographic printing plate precursor no longer transfers inks to the printed sheets.

On-press developability of infrared radiation exposed lithographic printing precursors is particularly enhanced when the precursor comprises one or more polymeric binder materials (whether free radically polymerizable or not) in an infrared radiation-sensitive image-recording layer, at least one of which polymeric binders is present as particles having an average diameter of at least 50 nm and up to and including 400 nm.

The present invention provides at least the following embodiments and combinations thereof, but other combinations of features are considered to be within the present invention as a skilled artisan would appreciate from the teaching of this disclosure:

1. A lithographic printing plate precursor comprising a substrate, and one or more infrared radiation-sensitive image-recording layers disposed on the substrate, the lithographic printing plate precursor further comprising one or more infrared radiation absorbers and an ozone-blocking material in at least one of the one or more infrared radiation-sensitive image-recording layers, which ozone-blocking material has a molecular weight of 1500 or less and is represented by the following structure (I), (II), or (III):

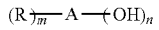

(I)

wherein R is a hydrocarbon group having 14 to 30 carbon atoms; m is 1 or 2; n is 1 to 6; the sum of m and n is greater than 2 (or greater than 3) and less than 8; and A is a multivalent organic moiety that is free of R and OH groups, and A has a valence equal to the sum of m and n;

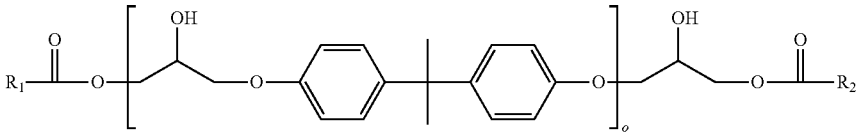

(II)

wherein $R_1$ and $R_2$ are independently alkyl groups having 14 to 22 carbon atoms, and o is an integer of 1 to 3; and $R_3C(=O)NR_4R_5$ (III)

wherein $R_3$ is an alkenyl group comprising at least one C=C double bond within a carbon-carbon chain having 16 to 30 carbons, and $R_4$ and $R_5$ are independently a hydrogen atom or an unsubstituted alkyl group having 1 to 4 carbons.

2. The lithographic printing plate precursor of embodiment 1, wherein the ozone-blocking material is located at least within an outermost infrared radiation-sensitive image-recording layer of the one or more infrared radiation-sensitive image-recording layers.

3. The lithographic printing plate precursor of embodiment 1 or 2 that is a negative-working lithographic printing plate precursor comprising a negative-working infrared radiation-sensitive image-recording layer, wherein the ozone-blocking material and the one or more infrared radiation absorbers are located at least within the negative-working infrared radiation-sensitive image-recording layer.

4. The lithographic printing plate precursor of embodiment 3, wherein the negative-working infrared radiation-sensitive image-recording layer is the outermost layer.

5. The lithographic printing plate precursor of embodiment 3 or 4, wherein the negative-working infrared radiation-sensitive image-recording layer further comprises:

a) one or more free radically polymerizable components; and b) an initiator composition capable of generating free radicals, and the negative-working infrared radiation-sensitive image-recording layer optionally further comprises one or more non-free radically polymerizable polymeric materials that are different from the a), b), one or more infrared radiation absorbers, and the ozone blocking material of structure (I), (II), or (III).

6. The lithographic printing plate precursor of embodiment 5, wherein the non-free radically polymerizable polymeric material is present in particulate form.

7. The lithographic printing plate precursor of any of embodiments 1 to 6, wherein the R hydrocarbon group is a linear or branched alkyl group.

8. The lithographic printing plate precursor of any of embodiments 1 to 7, wherein the ozone-blocking material comprises one or more of the following materials:

sorbitan monostearate, sorbitan mono-palmitate, sorbitan mono-myristate, sorbitan mono-behenate, sorbitan distearate, sorbitan dipalmitate, sorbitan dimyristate, sorbitan dibehenate, glycerol monostearate, glycerol mono-palmitate, glycerol mono-myristate, glycerol mono-behenate, oleamide, erucamide, and compounds represented by the following structure (II):

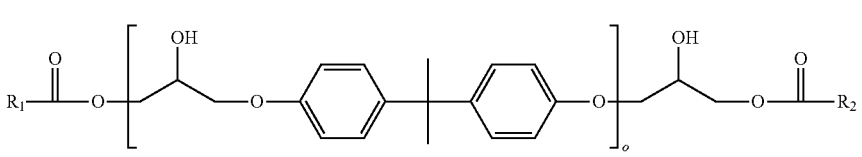

(II)

wherein $R_1$ and $R_2$ are independently alkyl groups having 14 to 22 carbon atoms, and, o is an integer of 1 to 3.

9. The lithographic printing plate precursor of any of embodiments 1 to 8, wherein at least one of the one or more infrared radiation absorbers is an infrared absorbing cyanine dye.

10. The lithographic printing plate precursor of any of embodiments 1 to 9, wherein the ozone-blocking material is present within the at least one of the one or more infrared radiation-sensitive image-recording layers in an amount of at least 1 weight % and up to and including 15 weight %, based on the total solids of the at least one of the one or more infrared radiation-sensitive image-recording layers.

11. The lithographic printing plate precursor of any of embodiments 1 to 10, comprising a negative-working infrared radiation-sensitive image-recording layer comprising the ozone-blocking material and the one or more infrared radiation absorbers, which negative-working infrared radiation-sensitive recording layer is removable on-press using a lithographic ink, a fountain solution, or a combination of a lithographic ink and a fountain solution in regions that are not exposed to infrared radiation.

12. The lithographic printing plate precursor of embodiment 11, wherein the ozone-blocking material is present within the negative-working infrared radiation-sensitive image-recording layer in an amount of at least 2 weight % and up to and including 10 weight %, based on the total solids of the negative-working infrared radiation-sensitive image-recording layer.

13. The lithographic printing plate precursor of embodiment 11, wherein the negative-working infrared radiation-sensitive image-recording layer comprises:

a) one or more free radically polymerizable components; and b) an initiator composition capable of generating free radicals, and the negative-working infrared radiation-sensitive image-recording layer optionally further comprising one or more non-free radically polymerizable polymeric materials that are different from the a), b), one or more infrared radiation absorbers, and ozone blocking materials defined above.

14. The lithographic printing plate precursor of embodiment 13, wherein the negative-working infrared radiation-sensitive image-recording layer comprises at least two free radically polymerizable components.

15. The lithographic printing plate precursor of any of embodiments 1 to 14, wherein the substrate comprises an aluminum-containing substrate comprising an aluminum oxide layer, and a hydrophilic polymer coating that is disposed on the aluminum oxide layer.

16. The lithographic printing plate precursor of any of embodiments 1 to 15, wherein the ozone blocking material of Structure (I), (II), or (III) is present in an amount of at least 2 weight % and up to and including 10 weight %, and the one or more infrared radiation absorbers are present in an amount of at least 0.5 weight % and up to and including 30 weight %, all based on the total weight of the infrared radiation-sensitive image-recording layer.

17. A method for providing a lithographic printing plate, comprising:

A) imagewise exposing the lithographic printing plate precursor according to any of embodiments 1 to 16 to imaging infrared radiation, to provide exposed regions and non-exposed regions in the one or more infrared radiation-sensitive image-recording layers, and B) removing either the exposed regions or the non-exposed regions in the one or more infrared radiation-sensitive image-recording layers from the substrate.

18. The method of embodiment 17, wherein the lithographic printing plate precursor is a negative-working lithographic printing plate precursor comprising a negative-working infrared radiation-sensitive image-recording layer comprising the ozone-blocking material and the one or more infrared radiation absorbers, and the method comprises removing the non-exposed regions in the negative-working infrared radiation-sensitive image-recording layer from the substrate on-press using a lithographic printing ink, a fountain solution, or a combination of a lithographic printing ink and a fountain solution.

The following examples are provided to further illustrate the practice of the present invention and are not meant to be limiting in any manner. Unless otherwise indicated, the materials used in the examples were obtained from various commercial sources as indicated but other commercial sources may be available.

Inventive and Comparative Examples

An aluminum-containing substrate was prepared for the lithographic printing plate precursors in the following manner:

A surface of an aluminum alloy sheet (support) was subjected to an electrolytic roughening treatment using hydrochloric acid. The resulting grained aluminum sheet was subjected to an anodizing treatment using an aqueous phosphoric acid solution to form an aluminum oxide layer, followed by a post-treatment application of a poly(acrylic acid) solution, to provide an aluminum-containing substrate with a hydrophilic surface.

A negative-working, infrared radiation-sensitive image-recording layer was then formed on samples of the hydrophilic surface of the aluminum-containing substrate by individually coating a negative-working infrared radiation-sensitive composition formulation having the components shown in the following TABLE I, dissolved or dispersed at a total solids content of 5 weight % in a coating solvent containing 33 weight % of n-propanol, 15 weight % of 2-methoxy propanol, 45 weight % of 2-butanone, and 7 weight % of water. Coating of each formulation was carried out using a wire-wound coating bar and the coating was dried 80° C. for 2 minutes to provide a negative-working infrared radiation-sensitive image-recording layer having a dry coverage of 1 g/m$^2$. The raw materials noted in TABLE II can be obtained from one or more commercial sources of chemicals or prepared using known synthetic methods.

TABLE I

| | Comparative Example 1 | Invention Example 1 | Invention Example 2 | Invention Example 3 | Invention Example 4 | Invention Example 5 | Invention Example 6 | Comparative Example 2 | Comparative Example 3 | Comparative Example 4 | Comparative Example 5 |
|---|---|---|---|---|---|---|---|---|---|---|---|
| Polymer 1 | 30.00 | 30.00 | 30.00 | 30.00 | 30.00 | 30.00 | 30.00 | 30.00 | 30.00 | 30.00 | 30.00 |
| Polymerizable compound 1 | 45.00 | 45.00 | 45.00 | 45.00 | 45.00 | 45.00 | 45.00 | 45.00 | 45.00 | 45.00 | 45.00 |
| Polymer 2 | 6.00 | 6.00 | 6.00 | 6.00 | 6.00 | 6.00 | 6.00 | 6.00 | 6.00 | 6.00 | 6.00 |
| Initiator 1 | 10.00 | 10.00 | 10.00 | 10.00 | 10.00 | 10.00 | 10.00 | 10.00 | 10.00 | 10.00 | 10.00 |
| IR Dye 1 | 4.00 | 4.00 | 4.00 | 4.00 | 4.00 | 4.00 | 4.00 | 4.00 | 4.00 | 4.00 | 4.00 |
| Leuco Dye 1 | 4.00 | 4.00 | 4.00 | 4.00 | 4.00 | 4.00 | 4.00 | 4.00 | 4.00 | 4.00 | 4.00 |
| Surfactant 1 | 1.00 | 1.00 | 1.00 | 1.00 | 1.00 | 1.00 | 1.00 | 1.00 | 1.00 | 1.00 | 1.00 |
| Ozone blocker 1 | | 8.00 | | | | | | | | | |
| Ozone blocker 2 | | | 8.00 | | | | | | | | |
| Ozone blocker 3 | | | | 8.00 | | | | | | | |
| Ozone blocker 4 | | | | | 8.00 | | | | | | |
| Ozone blocker 5 | | | | | | 8.00 | | | | | |
| Ozone blocker 6 | | | | | | | 8.00 | | | | |
| Ozone blocker 7 | | | | | | | | 8.00 | | | |
| Ozone blocker 8 | | | | | | | | | 8.00 | | |
| Ozone blocker 9 | | | | | | | | | | 8.00 | |
| Ozone blocker 10 | | | | | | | | | | | 8.00 |
| Total | 100.00 | 108.00 | 108.00 | 108.00 | 108.00 | 108.00 | 108.00 | 108.00 | 108.00 | 108.00 | 108.00 |

TABLE II

| | |
|---|---|
| Polymer 1 | Copolymer derived from acrylonitrile, styrene, and polyethylene glycol methyl ether methacrylate (Molecular weight of 2000) applied from a polymer dispersion and prepared like Polymer A in U.S. Pat. No. 7,592,128 (Huang et al.), the disclosure of which is incorporated herein by reference |

TABLE II-continued

| | |
|---|---|
| Polymer 2 | Hydroxypropyl cellulose having a weight average molecule of about 80,000 |
| IR dye 1 | 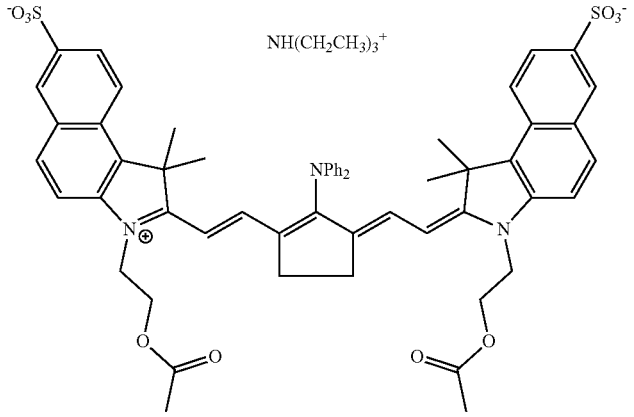 |
| Leuco dye 1 | 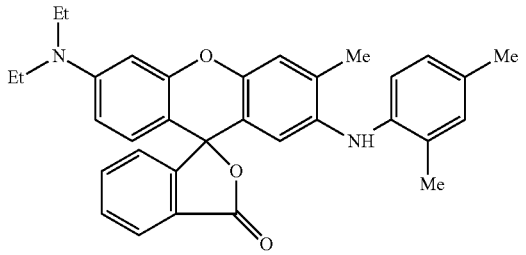 |
| Surfactant 1 | BYK ® 302, Surfactant from Byk Chemie, used as a 25 weight % solution in 1-methoxy-2-propanol |
| Initiator 1 | Bis(t-butylphenyl)iodonium tetraphenyl borate |
| Polymerizable compound 1 | UN-904, Polyfunctional urethane acrylate (available from Negami Chemical Corporation, Japan) |
| Ozone blocker 1 | Sorbitan monostereate (available from Sigma-Aldrich) |
| Ozone blocker 2 | Glycerol monosterate (available from Sigma Aldrich) |
| Ozone blocker 3 | BYK ® S740, Available from BYK Chemie and contains isoalkane solvent, paraffin wax and a mixture of compounds represented by Structure (II) shown herein, wherein $R_1$ and $R_2$ are linear alkyl groups having 13, 15, and 17 carbon atoms and n is 1 to 3. The predominant compound in the mixture of compounds has both $R_1$ and $R_2$ as 17 having 17 carbon atoms and n is 1. |
| Ozone blocker 4 | Oleamide (available from Tokyo Chemical Industry Co., Ltd.) |
| Ozone blocker 5 | Erucamide (available from Tokyo Chemical Industry Co., Ltd.) |
| Ozone blocker 6 | See synethetic procedure provided below |
| Ozone blocker 7 | Sorbitan monolaurate (available from Sigma Aldrich) |
| Ozone blocker 8 | 1-Docosanol (available from Sigma Aldrich) |
| Ozone blocker 9 | Behenic acid (available from Tokyo Chemical Industry Co., Ltd.) |
| Ozone blocker 10 | Stearamide (available from Tokyo Chemical Industry Co., Ltd.) |

Ozone blocker 6 is synthesized as follows:

To a 500 ml, three-necked, round bottom flask with a magnetic stir bar, 113 g (1.0 eq) of Bisphenol A diglycidyl ether (CAS No. 1675-54-3, purchased from Sigma-Aldrich), 188.8 g (2.0 eq) of stearic acid (CAS No. 57-11-4, purchased from Acros Organics), 53.6 g (0.5 eq) of tetrabutylammonium bromide (CAS No. 1643-19-2, purchased from Sigma-Aldrich), 75 ml of toluene, and 150 ml of acetonitrile were added and the mixture was heated to reflux for 18 hours using an oil bath at 85° C. The toluene and acetonitrile were then removed on a rotary evaporator under reduced pressure in a water bath set to 100° C. The resulting pale solid in the flask was then redissolved by adding 150 ml of acetonitrile and heating at 80° C. Upon cooling to room temperature, a precipitate came out of the acetonitrile solution and it was filtered by vacuum, dried, and collected as a white solid (145 g, 70% yield). Through proton NMR, the precipitated and collected product was found to contain ozone blocker 6 having the following structure at an estimated amount of >95%:

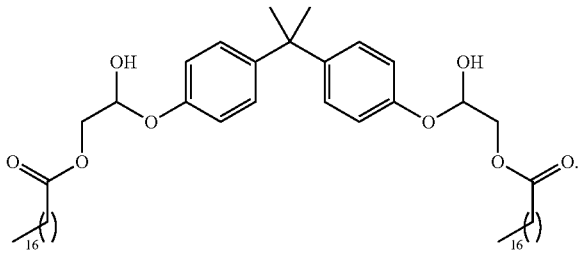

Evaluations of Lithographic Printing Plate Precursors:

Ozone Resistance (SR):

A sample of each of the lithographic printing plate precursors was exposed to a controlled amount of ozone inside of a commercially available humidity chamber ETAC FX-430 where the ozone concentration was controlled at 1 ppm and the chamber temperature was controlled at 25° C. The following equipment was used for controlling the ozone concentration:

Kotohira portable ozone generator KPO-T01 as the ozone source; and

Kanomax Gasmaster model 2750 as the ozone monitor.

The ozone exposure times were 6 hours and 18 hours, corresponding to ozone exposure doses of 21,600 ppm·s and 64,800 ppm·s, respectively. In the unit "ppm·s", ppm is a unit of ozone concentration in parts per million by volume and s is short for second, a unit of time. To determine the amount of infrared radiation absorber (IR Dye 1) left in the infrared radiation-sensitive image recording layer, the infrared radiation-sensitive image-recording layer on 50 $cm^2$ of each precursor was extracted by 37.5 g of γ-butyrolactone (BLO) and the absorption spectrum of the resulting BLO solution was taken using a UV-vis spectrometer U-2810 (Hitachi High-Tech Corporation). The absorbance at the absorption peak of IR Dye 1 (Abs. hereafter) was determined from the absorption spectrum. The Abs. of the IR dye in the precursor without exposure to ozone was also determined as a reference value. The parameter "Survival Rate" (SR) as a measure of ozone resistance, was calculated using the following equation, and the higher the % SR the better resistance the precursor has to ozone degradation:

SR [%]=(Abs. after exposure to ozone)/(Abs. without exposure to ozone)×100%.

On-Press Developability (DOP):

Samples of each of the lithographic printing plate precursors with or without ozone exposure were imaged using a commercially available KODAK® Magnus 800 imagesetter at an infrared radiation exposure energy of 150 $mJ/cm^2$ in a solid area and mounted onto a commercially available Roland 200 printing press (Man Roland) that was run at 9,000 revolution per hour, using a mixture of 1 volume % isopropanol, 1 volume % of NA-108W (available from DIC Graphics, Japan), and 98 volume % water as the fountain solution, a blanket of S-7400 (available from Kinyosha, Japan), OK topcoat paper matte N grade paper (available from Oji Paper, Japan) as the printing paper, and Fusion G Magenta N grade lithographic ink (available from DIC Graphics, Japan).

On-press developability (DOP) was evaluated by the following procedure: A dampening roller was first engaged and a dampening solution was supplied. After 3 revolutions, the inking rollers were engaged, which supplied the lithographic printing ink to cover the entire printing surface of the lithographic printing plate. The printing sheets were fed right after engagement of the inking roller. DOP was defined as the number of printed paper sheets after which no ink transfer was observed in the non-imaged areas. A DOP of less than 50 sheets is desirable, and a DOP of more than 100 sheets is unacceptable for this printing press condition.

Press Life:

Samples of each of the lithographic printing plate precursors, with and without ozone exposure were imagewise exposed to laser infrared radiation as described above at a rate of 150 $mJ/cm^2$. The obtained imaged precursor samples were mounted onto a commercially available Komori S-26 press machine at 8,000 rpm and printing press life was evaluated using a mixture of 1 volume % of K701 (DIC Graphics) and 10 volume % of isopropanol in water as a fountain solution, a blanket of S-7400 (Kinyosha), OK topcoat paper matte N grade paper (Oji paper) as the printing paper, and the K Magenta N grade lithographic ink (DIC Graphics).

When the number of printed paper sheets was increased by continued lithographic printing, the image-recording layer of the lithographic printing plate was gradually worn away, and the ink receptivity thereof deteriorated. Thus, the ink density on the printed paper sheets was reduced. The press life was determined as the number of copies when the reflection density of a solid area on the obtained copy was reduced to 90% of that when the lithographic printing was started. The greater the number of the sheets when this degradation occurred, the better the press life.

The results of these tests are shown in the following TABLE III.

TABLE III

| | SR (Ozone Resistance) Exposed ozone (ppm · s) | | Press life (Sheets) Exposed ozone (ppm · s) | | | DOP (Sheets) Exposed ozone (ppm · s) | | |
|---|---|---|---|---|---|---|---|---|
| | 21,600 | 64,800 | 0 | 21,600 | 64,800 | 0 | 21,600 | 64,800 |
| Comparative Example 1 | 36% | 24% | 100,000 | 35,000 | 20,000 | 30 | 28 | 28 |
| Invention Example 1 | 92% | 90% | 100,000 | 95,000 | 90,000 | 30 | 30 | 30 |
| Invention Example 2 | 92% | 90% | 100,000 | 95,000 | 90,000 | 50 | 50 | 40 |
| Invention Example 3 | 85% | 76% | 100,000 | 80,000 | 75,000 | 30 | 28 | 25 |
| Invention Example 4 | 87% | 80% | 100,000 | 95,000 | 90,000 | 30 | 30 | 30 |
| Invention Example 5 | 92% | 85% | 100,000 | 95,000 | 90,000 | 30 | 30 | 30 |
| Invention Example 6 | 92% | 90% | 100,000 | 95,000 | 90,000 | 30 | 30 | 30 |
| Comparative Example 2 | 30% | 6% | 75,000 | <500 | <500 | 30 | 28 | 25 |
| Comparative Example 3 | 83% | 74% | 100,000 | 80,000 | 75,000 | 250 | 250 | 240 |
| Comparative Example 4 | 85% | 78% | 100,000 | 80,000 | 75,000 | 300 | 300 | 290 |
| Comparative Example 5 | 90% | 82% | 100,000 | 95,000 | 90,000 | 300 | 300 | 300 |

From the results shown in TABLE III, it can be seen that the precursors of Invention Examples 1, 3, 4, 5, and 6 containing an inventive ozone-blocking material of Structures (I), (II) and (III) exhibited higher SR after ozone exposure than the precursor of Comparative Example 1 that did not contain the inventive ozone-blocking material. In addition, the press life of the precursors of Invention Examples 1, 3, 4, 5, and 6 after ozone exposure appeared to be longer than the press life for the precursor of Comparative Example 1 after exposure to ozone. It was also observed that the DOP of imaged precursors of Invention Examples 1, 3, 4, 5, and 6 was acceptably fast, that is, less than 50 sheets.

The precursor of Comparative Example 2 containing sorbitan monolaurate in the infrared radiation-sensitive image-recording layer instead of an inventive ozone-blocking material of Structure (I) showed very low SR and unacceptably short press life after ozone exposure.

Although the precursors of Comparative Examples 3, 4, and 5 showed higher SR and longer press life after ozone exposure than the precursor of Comparative Example 1, after imaging, those precursors showed much slower (and unacceptable) DOP than the imaged precursor of Comparative Example 1 and the imaged precursors of Invention Examples 1, 3, 4, 5, and 6.

Thus, the cumulative data provided above demonstrate that the precursors of the present invention exhibited improved resistance to ozone while exhibiting desirably fast DOP properties.

The invention has been described in detail with particular reference to certain preferred embodiments thereof, but it will be understood that variations and modifications can be effected within the spirit and scope of the invention.

The invention claimed is:

1. A negative-working lithographic printing plate precursor comprising a substrate, and an outermost negative-working infrared radiation-sensitive image-recording layer disposed on the substrate, wherein the outermost negative-working infrared radiation-sensitive image-recording layer comprises:

a) one or more free radically polymerizable components; and b) an initiator composition capable of generating free radicals, the outermost negative-working infrared radiation-sensitive image-recording layer further comprising one or more infrared radiation absorbers; and an ozone-blocking material that has a molecular weight of 1500 or less and is represented by the following structure (I), (II), or (III):

$$(R)_m\text{—}A\text{—}(OH)_n \quad \text{(I)}$$

wherein R is a hydrocarbon group having 14 to 30 carbon atoms; m is 1 or 2; n is 1 to 6; the sum of m and n is greater than 2 and less than 8; and A is a multivalent organic moiety that is free of R and OH groups, and A has a valence equal to the sum of m and n;

(II)

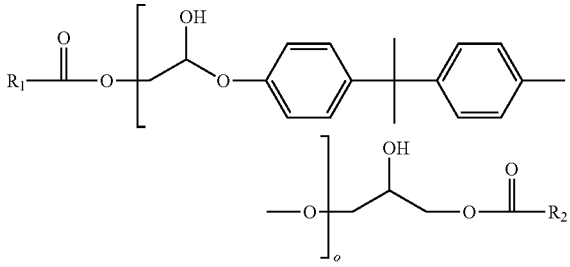

wherein $R_1$ and $R_2$ are independently alkyl groups having 14 to 22 carbon atoms, and o is an integer of 1 to 3; and $$R_3C(=O)NR_4R_5 \quad \text{(III)}$$

wherein $R_3$ is an alkenyl group comprising at least one C=C double bond within a carbon-carbon chain having 16 to 30 carbon atoms, and $R_4$ and $R_5$ are independently a hydrogen atom or an unsubstituted alkyl group having 1 to 4 carbon atoms, and the negative-working infrared radiation-sensitive image-recording layer optionally further comprising one or more non-free radically polymerizable polymeric materials that are different from the a), b), the one or more infrared radiation absorbers, and the ozone-blocking material of structure (I), (II), or (III).

2. The negative-working lithographic printing plate precursor of claim 1, wherein the one or more non-free radically polymerizable polymeric materials are present in the outermost negative-working infrared radiation-sensitive image-recording layer in particulate form.

3. The negative-working lithographic printing plate precursor of claim 1, wherein the R hydrocarbon group is a linear or branched alkyl group.

4. The negative-working lithographic printing plate precursor of claim 1, wherein the ozone-blocking material of structure (I), (II), or (III) comprises one or more of the following materials:

sorbitan monostearate, sorbitan mono-palmitate, sorbitan mono-myristate, sorbitan mono-behenate, sorbitan distearate, sorbitan dipalmitate, sorbitan dimyristate, sorbitan dibehenate, glycerol monostearate, glycerol mono-palmitate, glycerol mono-myristate, glycerol mono-behenate, oleamide, erucamide, and compounds represented by the following structure (II):

(II)

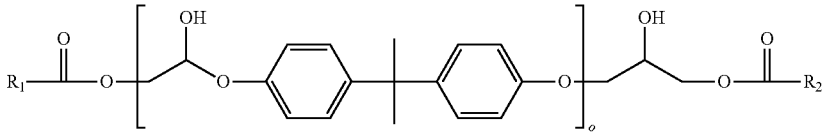

wherein $R_1$ and $R_2$ are independently alkyl groups having 14 to 22 carbon atoms, and o is an integer of 1 to 3.

5. The negative-working lithographic printing plate precursor of claim 1, wherein at least one of the one or more infrared radiation absorbers is an infrared absorbing cyanine dye.

6. The negative-working lithographic printing plate precursor of claim 1, wherein the ozone-blocking material is present within the outermost negative-working infrared radiation-sensitive image-recording layer in an amount of at least 1 weight % and up to and including 15 weight %, based on the total solids of the outermost negative-working infrared radiation-sensitive image-recording layer.

7. The negative-working lithographic printing plate precursor of claim 1, wherein the outermost negative-working infrared radiation-sensitive recording layer is removable on-press using a lithographic ink, a fountain solution, or a combination of a lithographic ink and a fountain solution in regions that are not exposed to infrared radiation.

8. The negative-working lithographic printing plate precursor of claim 1, wherein the ozone-blocking material is present within the outermost negative-working infrared radiation-sensitive image-recording layer in an amount of at least 2 weight % and up to and including 10 weight %, based on the total solids of the outermost negative-working infrared radiation-sensitive image-recording layer.

9. The negative-working lithographic printing plate precursor of claim 1, wherein the outermost negative-working infrared radiation-sensitive image-recording layer comprises at least two free radically polymerizable components.

10. The negative-working lithographic printing plate precursor of claim 1, wherein the substrate comprises an aluminum-containing substrate comprising an aluminum oxide layer, and a hydrophilic polymer coating that is disposed on the aluminum oxide layer.

11. The negative-working lithographic printing plate precursor of claim 1, wherein the ozone blocking material of structure (I), (II), or (III) is present in an amount of at least 2 weight % and up to and including 10 weight %, and the one or more infrared radiation absorbers are present in an amount of at least 0.5 weight % and up to and including 30 weight %, all based on the total weight of the outermost negative-working infrared radiation-sensitive image-recording layer.

12. A method for providing a lithographic printing plate, comprising:

A) imagewise exposing the negative-working lithographic printing plate precursor according to claim 1 to imaging infrared radiation, to provide exposed regions and non-exposed regions in the outermost negative-working infrared radiation-sensitive image-recording layer, and B) removing the non-exposed regions in the outermost negative-working infrared radiation-sensitive image-recording layer from the substrate.

13. The negative-working lithographic printing plate precursor of claim 1, wherein the outermost negative-working infrared radiation-sensitive image-recording layer is the only infrared radiation-sensitive image-recording layer of the negative-working lithographic printing plate precursor.

* * * * *